United States Patent [19]

Watanabe

[11] 4,257,358

[45] Mar. 24, 1981

[54] BOILER

[75] Inventor: Masashi Watanabe, Kamakura, Japan

[73] Assignee: Ebara Corporation, Tokyo, Japan

[21] Appl. No.: 51,740

[22] Filed: Jun. 25, 1979

[51] Int. Cl.[3] ..... F22B 21/00

[52] U.S. Cl. ..... 122/235 R; 122/333; 122/356

[58] Field of Search ..... 122/235 R, 235 K, 235 Q, 122/235 S, 140 A, 333, 356, 362

[56] References Cited

U.S. PATENT DOCUMENTS

| | | | |
|---|---|---|---|
| 3,601,098 | 8/1971 | Kraus | 122/235 R |
| 3,633,550 | 1/1972 | Kraus | 122/235 R |

OTHER PUBLICATIONS

Catalog No. 0640 1, Ebara Corporation.

Pages 43 thru 63 of "Schnelldampferzeuger mit Olfeuerung" by Richard Heerwagen, 1966, Verlag A. W. Gentner KG, Stuttgart.

Pages 32 thru 37 of "Ebara Engineering Review" No. 91, Mar. 1975.

Pages 96 and 97 of "Ebara Engineering Review" No. 11, Apr. 1977.

*Primary Examiner*—Anthony V. Ciarlante

*Attorney, Agent, or Firm*—Wenderoth, Lind & Ponack

[57] ABSTRACT

A boiler is presented improved in capacity and efficiency and causing less pollution and noise wherein a first tubular wall means and a second tubular wall means outwardly of the first wall means encompassing the first wall means therein are disposed within a boiler casing to form a combustion chamber inside of the first wall means, each of the wall means comprising an outer wall and inner wall to form a space therebetween which is coupled with the both chambers to allow communication therebetween through the space, gas duct means extending from the combustion chamber to outside of the boiler casing within the spaces of the respective wall means in a mandering fashion utilizing gaps formed between the first and second wall means and between the second wall means and the boiler casing.

Additional gas passage means may be provided in the first wall means or in the both wall means so as to diverge the combustion gas flow adjacent opening means of the duct means sucking the combustion gas.

12 Claims, 10 Drawing Figures

BOILER

This invention relates to a boiler, and more particularly to a boiler having improved capacity and efficiency.

Heretofore, several types of boilers have been proposed and used which are satisfactory to some extent.

However, in order to reduce the complaints regarding pollution, to reduce the installation cost, and to cope with the demand for saving of energy, there has constantly been a need for improving the capacity and efficiency of a boiler while satisfying the desired conditions, such as above.

In general, there are two approaches to improve the capacity and efficiency of a boiler. That is:

(a) increasing the rate of transfer of thermal energy by raising the speed of combustion of gas while increasing the amount of fuel fed to a burner; and (b) providing as large effective heat transmitting surfaces as possible within the space within the boiler.

If the approach (a) above is relied on, the amount of power needed for an air supplying means such as a forced draft fan may become too large resulting in an increase in total power consumption and also causing a problem of noise. This is because the air drag or resistance is proportional to the square of the flow speed and the flow rate is proportional to the amount of fuel to be burned, so that the power required for the air supply is proportional to the cube of the amount of fuel to be supplied.

If the approach (b) above is used, construction of the heat transmitting surface may require increased speed of air flow which leads to an increase of the power required, although the thermal efficiency and capacity of the boiler will generally be increased as the amount of thermal energy transmitted per unit area is made smaller.

In the boilers of the prior art, an attempt has been made to provide a plurality of vertical water tubes between a pair of chambers with the central portion surrounded by the tubes forming a furnace. For example, such boilers are disclosed in Japanese Patent Public Disclosure Nos. 30341/64, 11210/71 and 34121/71. The boilers shown in these Disclosures operate satisfactorily. However, as stated above, there has been a further need for improvement in efficiency and capacity as well as for decreasing pollution.

Accordingly it is an object of this invention to provide a boiler having improved efficiency and capacity and causing less pollution.

It is a further object of this invention to provide a novel construction of a boiler which improves the efficiency and capacity of the boiler while reducing environmental noise and pollution.

It is also an object of the present invention to provide a construction of a boiler which can function either as a circulation type or a once-through type.

According to the present invention, the above objects are attained by providing a pair of annular chambers connected by a tubular wall means which comprises an outer wall and an inner wall defining a space therebetween, said two chambers being in communication with each other through the space, a room defined by the two chambers and the wall means being utilized as a combustion chamber into which a burner extends through a center hole in one of the annular chambers, gas duct means being provided so as to direct combustion gas from the combustion chamber through said inner wall at a place adjacent one of said chambers and through said outer wall at a place adjacent the other of said chambers to the outside of the boiler. The wall means may be constructed by contiguously arranging a plurality of water tubes. Within each of the wall means duct means are provided so as to direct the combustion gas to the outside of the boiler.

The advantages and effects of the present invention other than those already touched upon will be clarified in the detailed description of the following preferred embodiments in conjunction with the accompanying drawings in which.

Figure 9A:
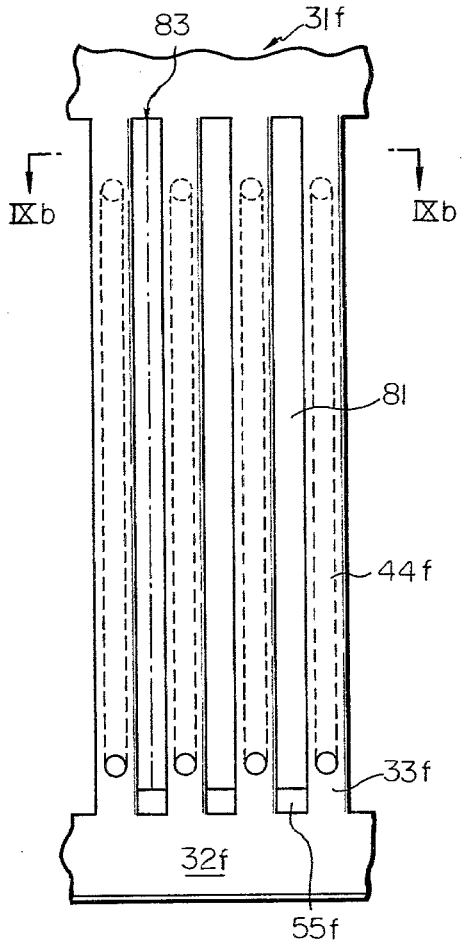
Figure 9B:
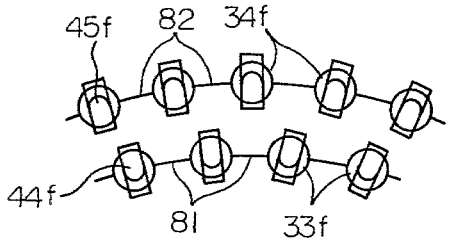

FIG. 9*a* is a schematic illustration showing a part of the inner tube wall surrounding a combustion chamber constructed by finned tubes or the like; and FIG. 9*b* is a cross section taken along line IXb—IXb in FIG. 9*a*.

Before explaining the present invention, a discussion of the prior art boilers is presented to assist the understanding of the present invention.

Figure 1:
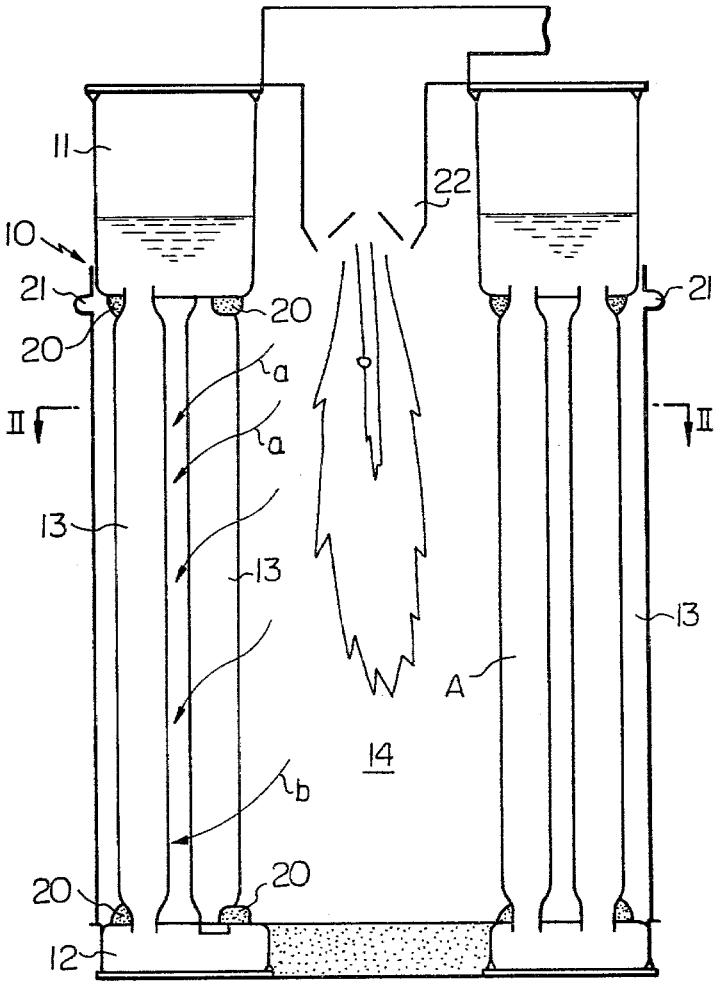
Fig. 1 (PRIOR ART)
FIG. 1 is a schematic illustration of a sectional view of a prior art boiler which is described herein for explaining the background of the present invention.
Figure 2:
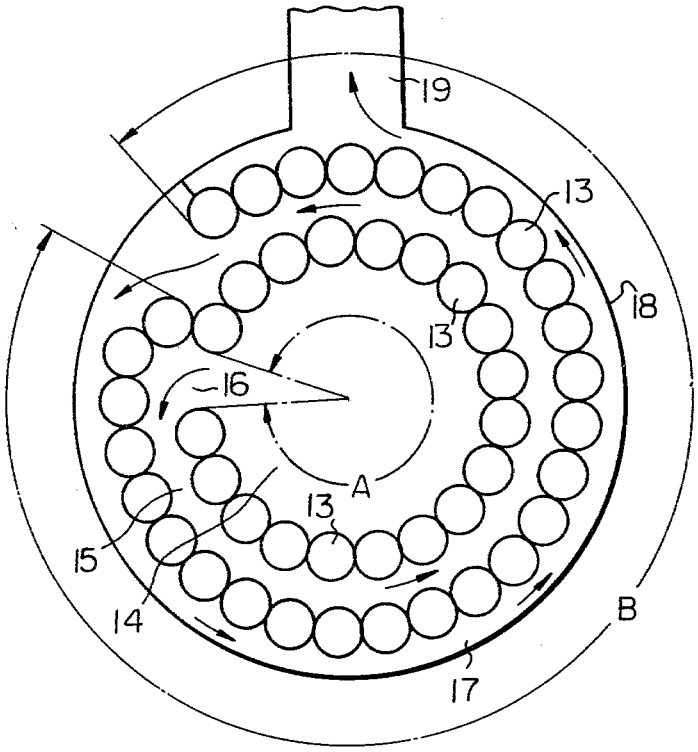
Fig. 2 (PRIOR ART)
FIG. 2 is a cross sectional view taken along the line II—II in FIG. 1.

In FIGS. 1 and 2, a prior art boiler 10 is illustrated which is a natural circulation water tube type boiler. The boiler 10 comprises an upper annular water chamber 11 and a lower annular water chamber 12 between which a plurality of water tubes 13 are disposed contiguously in a spiral fashion forming a tangent tube wall as illustrated in FIG. 2 to form a combustion chamber or furnace 14 at the center of the spirally formed tangent tube wall which may be divided into an inner portion "A" and an outer portion "B". The portions "A" and "B" form a flue 15 between the portions "A" and "B" extending from an intake 16 opening to the chamber 14 and form a flue 17 between the portion "B" and an outer wall 18 of the boiler 10, the flues 15 and 17 guiding the combustion gas from the intake 16 to an exhaust duct 19 in the direction indicated by arrows in FIG. 2. The opposite ends of each of the water tubes 13 are narrowed and coupled to the upper and lower chambers 11 and 12 respectively so that the chambers 11 and 12 communicate with each other through the water tubes 13. Because of the narrowed portions of the respective tubes 13, gaps 20 are formed between the tubes adjacent the bottom of the upper water chamber 11 and the top of the lower water chamber 12 and these gaps are filled with suitable packing material or insulation material to isolate the furnace space 14 and flues 15 and 17 from each other. On the outer wall 18 of the boiler 10 a flexible portion 21 is provided for absorbing the deformation caused by the thermal stress. The center portion of the lower annular water chamber 12 may be filled with fire resisting packing material. At the center portion of the upper annular water chamber 11, a burner 22 is disposed in a manner to direct flame downwardly and blast air is supplied from a blower or a forced draft fan not shown.

When the burner 22 is ignited for operation, the inner side surfaces of the water tubes 13 in the portion "A" are exposed to heat radiation from the flame and convection from combustion gas, and the surfaces of the tubes 13 in the portions "A" and "B" facing the flue 15 and the surfaces of the tubes 13 in the portion "B" facing the flue 17 are also exposed to the combustion gas passing through the flues 15 and 17 thereby effecting heat transfer to the water in the tubes 13. By such heat transfer, the inner tubes belonging to the portion "A" will become riser tubes while the tubes belonging to the portion "B" will become the down comers due to the difference in the temperature of the water induced by the heat transfer and, thus, the circulation of the water is effected. Obviously the tubes in the portion "A" receive a larger amount of thermal energy. However, the boundary between the riser tubes and down comers may vary depending on the condition of transferring thermal energy to the water within the tubes.

It is possible to modify the arrangement of tubes 13 in FIG. 2 in order to reduce the velocity of combustion gas passing through the flues so that an the power required for operating the blower can be reduced. That is accomplished by directing the flue 15 from the intake 16 in two opposite directions and joining the oppositely directed flues at the point opposite the intake 16 after the combustion gas has travelled 180° of the circumference before entering into the succeeding flue corresponding to the flue 17 which again directed in opposite directions and merged at the exhaust located the same radial position as the intake 16. This arrangement of the flues will reduce the velocity of gas at the intermediate positions in the passage of combustion gas. The combustion gas at the upper portion in the furnace adjacent the burner 22 such as indicated with arrows "a" includes particles of oil discharged from the burner 22 before complete combustion and these unburned relatively large particles are directed to the flue 15 in the direction of the arrows "a" while the gas flowing into the flue 15 at the lower part of the intake 16 such as indicated by an arrow "b" is completely burned. The gas containing unburned particles is cooled during the passage through the flues and, thus, such particles are discharged to the outside without being burned thereby increasing the amount of soot and smoke. If it is desired to reduce such soot and smoke, it is necessary to increase the mixing efficiency adjacent the burner 22 so as to assist the combustion in the furnace 14 to become complete. Although the amount of soot and smoke may be reduced by such mixing, such mixing requires an increase in the capacity of an air blower or a forced draft fan thereby consuming more power. Also, the amount of $NO_x$ will be increased as the mixing is made more violent, which causes the problem of environmental pollution and noise.

The present invention, as stated earlier, obviates such problems as described in the foregoing in connection with the prior art boiler, for example, as illustrated in FIGS. 1 and 2.

Figure 3:
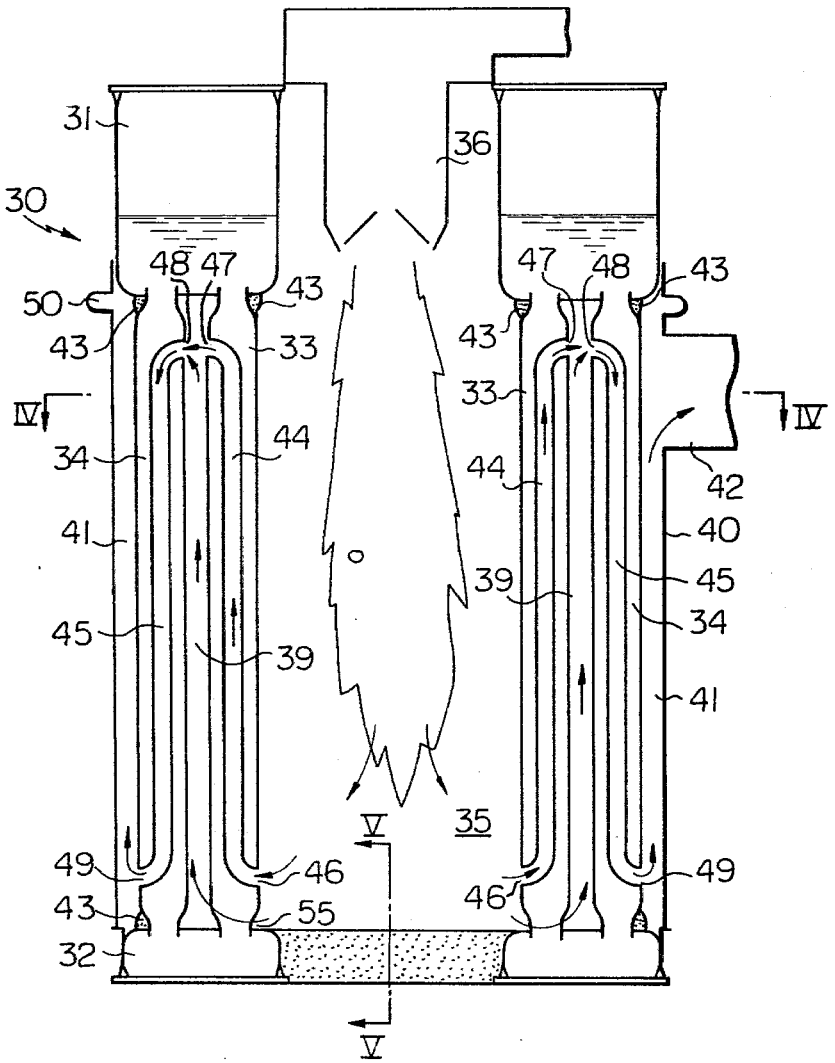
FIG. 3 is a schematic sectional illustration of a preferred embodiment of a boiler according to the present invention.
Figure 4:
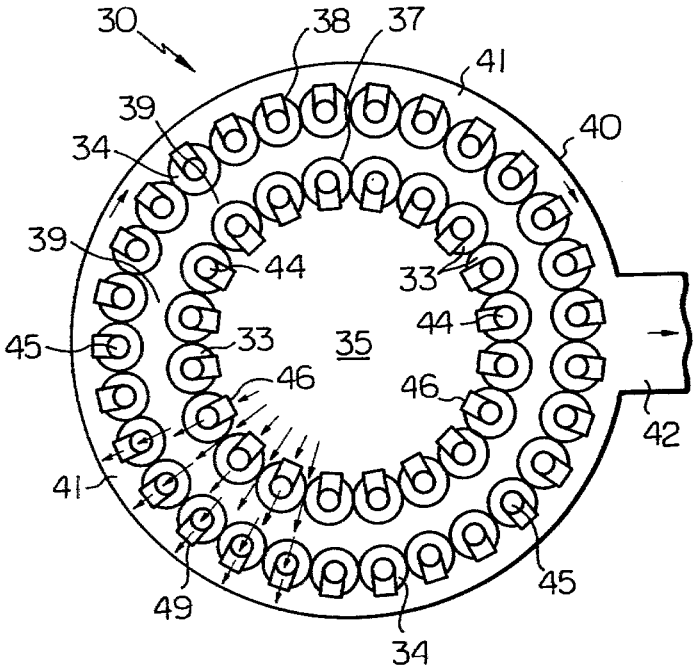
FIG. 4 is a cross-sectional view taken along the line IV-13 IV in FIG. 3.

Referring to FIGS. 3 and 4, there is shown a preferred embodiment of a boiler 30 according to the present invention. The boiler 30 as illustrated is a natural circulation type water tube boiler and comprises an upper annular water chamber 31, a lower annular water chamber 32, a group of tangent vertical water tubes 33 contiguously arranged to form a tangent tube wall having a cylindrical shape and another group of vertical water tubes 34 also contiguously arranged to form another tube wall of a second cylindrical shape coaxial with the first mentioned tube wall and disposed outwardly thereof with an annular space between the two as shown in FIG. 4. The opposite ends of each of the tubes 33 and 34 are reduced in diameter and coupled with the bottom plate of the upper water chamber 31 and the top plate of the lower water chamber 32 so that the two chambers communicate with each other through the tubes 33 and 34. The inner space surrounded by the group of tubes 33 is adapted to be a combustion chamber or furnace 35 into which a burner 36 is disposed and directed downwardly through a center aperture of the upper water chamber 31. The adjacent tangent tubes 33 and 34 are, as explained above, contiguously arranged to form a tube walls 37 and 38 and the adjacent tubes may be welded to each other to make the seal therebetween complete if necessary.

The space between the tube walls 37 and 38 is utilized as a flue 39 and the space between an outer wall 40 of the boiler and the tube wall 38 is also utilized as a flue 41 which is lead to an exhaust 42 for the combustion gas of the boiler.

Figure 5:
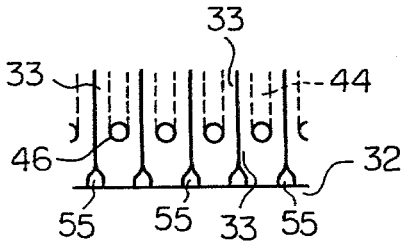
FIG. 5 is a fragmentary view taken along the line V—V in FIG. 3.

As illustrated in FIG. 4 a cross section of the inner cylindrical tube wall consisting of tangent tubes 33 and the outer cylindrical tube wall 38 consisting of tangent tubes 34 is a complete circle, respectively and, thus, there is no intake similar to the intake 16 shown in FIG. 2 for directing the gas from the chamber 35 to the intermediate flue 39. However, as explained above, the diameters of the opposite ends of respective tubes 33 and 34 are reduced so that the portions of the tube walls adjacent the bottom and top plates of the upper and lower water chambers, respectively, define gap passages permitting air to flow therethrough. For example, such passages 55 are shown in FIG. 5 in the lower part of the inner tube wall. These gap passages 55 permit the combustion gas to pass from the combustion chamber 35 to the intermediate flue 39. As will be made clear, the passages formed at the opposite ends of the tubes 33 and 34 except for gas passages similar to the passages 55 illustrated in FIG. 3 are filled with a suitable fire resisting packing material 43 to close the passages.

In order to provide a passage for the combustion gas from the furnace chamber 35 to the exhaust 42 which in addition to the flue 39, duct means is provided which extends through the tube wall 37. The duct means is constituted by gas ducts 44 extending from the furnace chamber 35 to the intermediate flue 39 through inside of some or all of the water tubes 33. The duct means for conducting gas from the flue 39 to the flue 41 is constituted by other gas ducts 45 extending from the flue 39 through the water tubes 34 to the outer flue 41. Each of the ducts 44 and 45 is comprised of a pipe. Each pipe constituting the duct 44 opens to the furnace chamber 35 at an intake opening 46 which is located adjacent the chamber 32 at the lower and of the tube 33 and extends upwardly inside of the tube 33 and opens into the flue 39 at a discharge opening 47 diametrically opposite the intake 46, the discharge opening 47 being positioned at the upper portion of the tube 33 adjacent each bottom plate of the water chamber 31. Similarly, the pipe constituting the gas duct 45 opens into the flue 39 at an intake opening 48 located at about the same height as that of the exhaust opening 47 and extends downwardly inside the tube 34 and opens into the flue 41 at a discharge opening 49 disposed in the lower portion of the tube 34 and diametrically opposite the intake opening 48. By the arrangement of the ducts described above, the passages for the combustion gas from the furnace chamber 35 to the exhaust 42 are completed. The center space in the lower water chamber 32 may be filled with packing material similar to the material 43 to complete the bottom of the furnace chamber. At an appropriate portion of the boiler wall 40, a flexible portion 50 is provided to absorb the thermal stress produced in the wall.

When the burner 36 is ignited, due to the heat radiated from the flame directed downwardly by an air flow supplied from the blower etc. and the heat transmitted by convection through the gas which is produced by the combustion, the inside surface of the tube wall 37 is heated. The combustion gas is directed into the intake openings 46 and gap passages 55 and is passed through the gas ducts 44 and the intermediate flue 39 and from the discharge openings 47 and the flue 39 to the ducts 45 through the intake openings 48 and discharge openings 49 in the tubes 34 and finally to the exhaust 42 through the flue 41. During the flow of the combustion gas described above, water in the tubes receives the thermal energy from the gas whereby the tubes 33 become riser tubes and the tubes 34 become down comers to effect natural circulation of the water in the boiler 30.

In the embodiment described above, the combustion gas flow directed past the inner tube wall 37 is regarded as divided into two parts, namely one entering into the gap passages 55 and the other entering into the intake openings 46. Because of the addition of the ducts 44, it is possible to maintain relatively low velocity of the combustion gas flow passing through the gap passages 55 and the intake openings 46 and, thus, the power consumption for the forced draft fan need not be increased. Further, due to the increase of the heat transferring surface by the arrangement of the gas ducts 44 and 45 in this embodiment, the capacity and efficiency are remarkably improved and the generation of soot, smoke and $NO_x$ is reduced because intake openings 45 and gap passages 55 are located at positions remote from the burner 36 so that only substantially completely burned gas is directed to the intakes 46 and gap passages 55 and violet mixing is not especially needed.

The following might be a repetition of the foregoing in a somewhat analytical way. In the embodiment described above, flow of the high temperature gas resulting from the combustion is divided into the two paths, one entering the intake 46 and the other entering the intermediate flue 39 through gap passages 55.

Resistance of a gas duct to the gas flowing therethrough may be generally expressed by the following equation:

$$\Delta P \alpha v^2 x \gamma$$

where $\Delta P$: resistance $v$: velocity of gas flow $\gamma$: density of gas

Therefore, the velocity is the most predominant factor creating the resistance or drag. Thus, adding the gas ducts 44 to the flue 39 so as to divide the gas flow will contribute to the reduction of $\Delta P$ by reducing the velocity in the separate passages. Further, as seen from the equation above, the density or volume is also related to the resistance and the volume (V) of gas is proportional to its absolute temperature as expressed by the equation $$V \propto \frac{273 + t(^\circ C.)}{273}.$$

Accordingly, the resistance of duct to the gas flow can be effectively reduced if the gas flow is divided when its temperature is relatively high.

In the embodiment illustrated in FIGS. 3 and 4, the burned gas at high temperature is divided into the two paths of the gas ducts 44 and the intermediate flue 39 and the divided gases merge again at the portion adjacent the discharge openings 47 after the diverged gases are cooled by heat transfer and thus their volumes are reduced. Therefore, the flow of the merged gas will not cause the resistance in the gas ducts 45 to be high. Further, as seen from the illustration in FIG. 4, the number of gas ducts 45 is greater than the number of the gas ducts 44, and since the volume of the gas has been reduced by heat transfer, the total resistance in the ducts 45 will be kept low even though the merged gas is directed to the single set of ducts 45. However, it is possible to provide a divided flow path for the merged flows from flue 39 and ducts 44, i.e. around the intakes 48. To such end, the packed material 43 at the respective upper portions of the water tubes 34 may be removed to provide a plurality of gap passages similar to the gap passages 55. Such provision of additional gaps will also reduce the velocity of gas flow.

Figure 6:
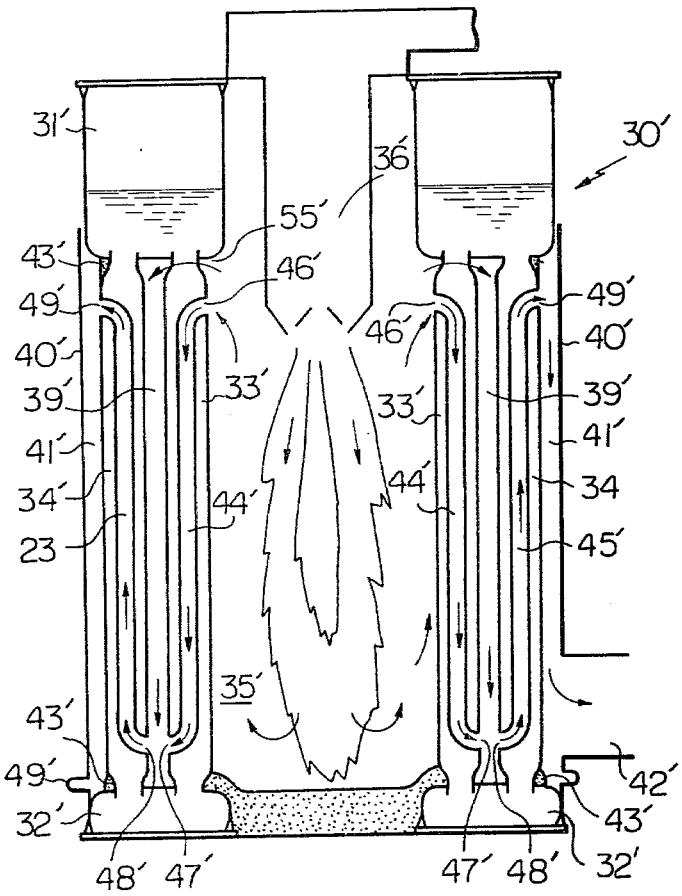
FIG. 6 is a cross-sectional view similar to FIG. 3 and illustrates another embodiment of the boiler of the present invention.

In FIG. 6, a further embodiment of the boiler according to the present invention is illustrated as a boiler 30'. Since the construction and effect of the elements in the boiler are almost the same except for a few points, the elements corresponding to those in the boiler 30 (FIGS. 3, 4 and 5) are given the same numerical references with a prime added, respectively. In the boiler 30', the combustion chamber or furnace 35' is a return flow burning type and, thus, a burner 36' with a long flame type is employed and installed in the furnace chamber so that the tip thereof is somewhat lower than the position of the burner in the boiler 30. The combustion gas is arranged to reach the bottom of the furnace where it is reversed to rise along the circumference of the combustion chamber 35'. The fuel is expected to be completely burned by the return flow burning and, therefore, a reduction in the amount of $NO_x$ can also be expected. In this embodiment, the respective positions of gap passages 55', intake openings 46', discharge openings 47', intake openings 38' and discharge openings 49' are reversed as compared to the corresponding ones shown in FIG. 3 with respect to the vertical positions, respectively and, accordingly, the direction of gas flow from the combustion chamber to the last flue 41' is also opposite to that in FIG. 3. Other elements not specifically referred to are the same as those in FIG. 3 with respect to their construction and effect.

Figure 7:
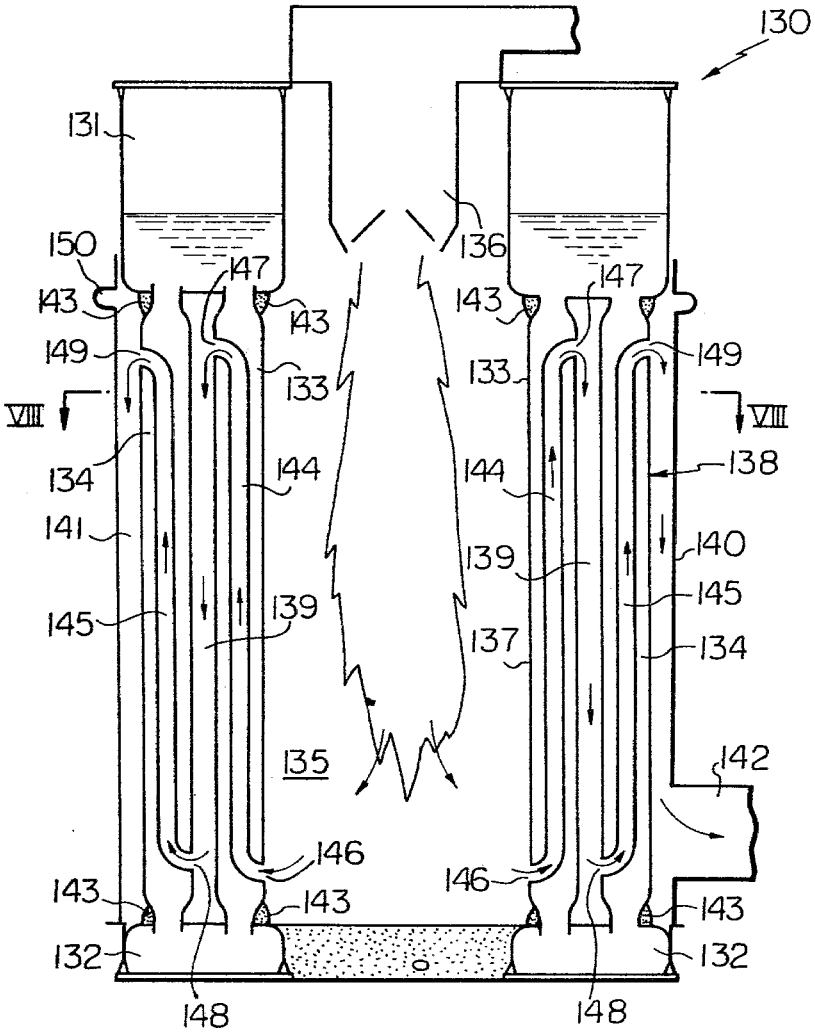
FIG. 7 is also a sectional schematic illustration of still another embodiment of the boiler according to the present invention.

In FIG. 7, a further embodiment according to the present invention is illustrated as a boiler 130. In this boiler too, almost all the elements are similar to those in FIG. 3 and, thus, the corresponding elements are given the same numerical references as in FIG. 3 but with "100" added thereto, respectively. Thus, the respective functions and constructions thereof can be understood from the corresponding parts in FIG. 3 by deleting "100", respectively therefrom. Similarly to FIG. 3, two tube walls 137 and 138 of tangent tubes are coaxially arranged within a boiler 130 to form a combustion chamber 135 and a first flue 139 and a second flue 141 as shown. The tube walls 137 and 138 comprise a plurality of water tubes 133 and 134, respectively which are contiguously arranged. In order to complete the passage for the combustion gas from the combustion chamber 135 to an exhaust opening 142 through the first flue 139 and the second flue 131, gas ducts 144 and 145 are provided within the water tubes 133 and 134, each gas duct 144 communicating with the furnace chamber 135 at an intake opening 146 disposed at a lower portion of the corresponding tube 133 and the opposite end of the duct 144 communicating with the first flue 139 at a discharge opening 147 disposed at an upper position of the corresponding tube 133 diametrically opposite the intake opening 146. Each duct 145 also opens to the first flue 139 at an intake opening 148 disposed at a lower position of the corresponding tube 134 around the same vertical position as the intake opening 146 and the opposite end of the duct 145 opens to the second flue 141 at a discharge opening 149 disposed diametrically opposite the intake opening 148 at an upper portion of the corresponding tube 134. By the arrangement of the ducts 144 and 145 in combination with the flues 139 and 141 and the exhaust opening 142, the combustion gas is guided to outside of the furnace from the furnace 135 in the direction indicated by the arrows. In the boiler 130, the gap passages similar to the gap passages 55 (FIGS. 3 and 5) are not provided in view of the direction of flow of the combustion gas, especially the flow in the first flue 139, and the corresponding portions are filled with a suitable fire resisting material 143. However, the increased total surface for effecting heat transfer improves the efficiency of the boiler.

The arrangement of the intake openings 146 and 148 and the discharge openings 147 and 149 may be reversed with respect to their vertical positions in the same way as is done in the embodiment of FIG. 6 so that the boiler can be converted to a return flow burning type by properly adjusting the height of the tip of the long flame type burner.

In the foregoing explanation, it has been pointed out that it is not mandatory to provide a gas duct in every water tube and some of the water tubes may be without such ducts. On such occasion, the number of ducts and distribution thereof in each of the tube walls may be appropriately determined in combination with the dimensions of the tubes, ducts and openings so as to facilitate the smooth operation of the boiler with high capacity and efficiency as well as to reduce the causes of environmental pollution. Similar consideration may also be applied to the provision of gap passages such as shown in FIGS. 3 and 5. The consideration above might be also advantageous in the boiler 130 (FIG. 7) since there is no division of the combustion gas flow. For example, the number of the ducts in the inner tube wall may be made more than that of the ducts in the outer tube wall so that the resistance in the ducts to the flow of combustion gas may be equalized throughout the entire path of the combustion gas. Also, absence of the ducts in some of the water tubes may facilitate circulation of the water in the boiler.

In the explanation of the foregoing embodiments, the water tubes have been described as being reduced in diameter at their opposite ends. However, straight tubes may also be employed except for the portions requiring the gap passages such as the gap passages 55 shown in FIGS. 3 and 5. The reduction of the tube diameter may be accomplished by any suitable means such as swaging the end of the tube or welding a small diameter tube to the end of the water tube.

In the foregoing, it has been explained that the adjacent tubes are contiguously arranged to form a tube wall of tangent tubes. However, a finned tube may be employed to construct the tube wall. A schematic illustration of such a wall is presented in FIGS. 9*a* and 9*b*.

FIG. 9*a* is part of an inner tube wall as viewed from the inside of the combustion chamber and the same references as in FIGS. 3, 4 and 5 are given to the elements or portions which are similar thereto in function with a suffix "f" added to each of the elements, respectively. Also, FIG. 9*b* is a cross section taken along a line IXb—IXb in FIG. 9*a*.

Inner water tubes 33*f* are joined with each other by fins 81 each of which is disposed in the space between adjacent tubes 33*f*. Each fin 81 may be sheet metal the material of which is preferably the same as that of the tube 33*f* and may be welded to the tubes 33*f* in advance or at the time of constructing the wall of the combustion chamber. Similarly, the outer wall may be constructed with tubes 34*f* and fins 82 to form the flue.

When fins are employed, tubes may be generally uniform in diameter throughout their length. The plates or sheets 81 and 82 may be made shorter than the length of the tubes to provide passages 55 as shown in FIG. 9*a* or the openings equivalent to the passages 55 may be provided in advance of the welding process. In the illustrated example, each of the fins 81 or 82 is shown as a single sheet or plate; however, the fins may be ones originally formed with the tubes and such fins may be welded at their longitudinal edges, such a welding line being represented by the chain line 83 in FIG. 9*a*. The construction of the wall in FIGS. 9*a* and 9*b* is intended to be included in the term "tube wall" as used in this specification and claims.

Figure 8:
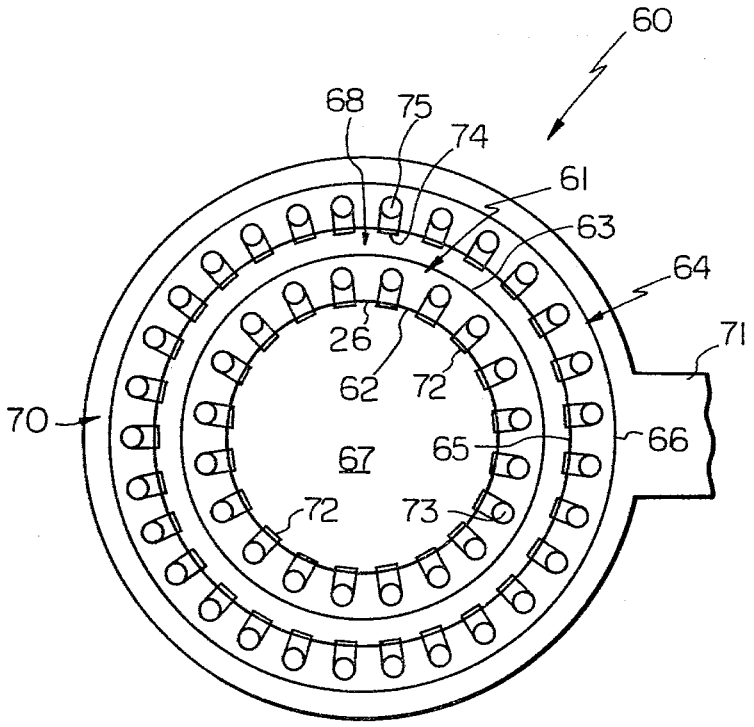
FIG. 8 is a cross-sectional view of a further embodiment of the present invention which may be regarded as corresponding to a section taken along the line VIII—VIII with an appropriate modification effected to the embodiment of FIG. 7.

Referring to FIG. 8, there is shown a cross-section of a still further modified a form boiler 60 according to the present invention. While in the embodiments hereinbefore described a plurality of tangent water tubes has been employed to construct the tube walls, in the boiler 60, such tube walls are replaced with double-walled members. An inner double-walled member 61 is comprised of an inner cylindrical wall 62 and an outer cylindrical wall 63 between which can be passed. Similarly outer double-walled member 64 comprises an inner cylindrical wall 65 and an outer cylindrical wall 66 the space between which is used for water passage. The space surrounded by the member 61 is utilized as a combustion chamber 67, the space between the member 61 and 64 is utilized as a first flue 68 and the space between the member 64 and a casing or outer wall 69 of the boiler is utilized as a second flue 70 communicating with an exhaust opening 71. The illustration shown in FIG. 8 may be regarded as equivalent to the cross-sectional view taken along the line VIII—VIII in FIG. 7 and, thus, only intake openings 72 for ducts 73 placing the combustion chamber 67 in communication with the first flue 68 and only intake openings 74 for ducts 75 are shown in FIG. 8. Of course, the ducts 73 and 75 open to the first and second flues 68 and 70, respectively so that a gas flow passage from the combustion chamber 67 to the exhaust opening 71 is completed. The arrangement illustrated in FIG. 8 provides great freedom in determining the distribution of flow through the gas ducts. The gap passages similar to passages 55 shown in FIGS. 3 and 5 as 37 may be also provided in the boiler 60 by providing tubes extending through the member 61 at appropriate portions thereof.

By the provision of gas ducts in the water tubes or the double-walled member, the surface for the heat transfer can be increased without scaling up all the dimensions of the boiler whereby the installation cost for the boiler according to this invention may be held down while still achieving the improvement in the capacity and efficiency as well as the reduction in the problems relating to environmental pollution and noise.

In the accompanying drawings, the upper and lower water chambers have been illustrated as circularly annular in shape, respectively. However, the shape of the water chambers is not limited to circular and they can have any annular shape provided that there is a central hole. For example, the shape may be an oval, square or rectangular provided that there is a center hole through which the burner extends where the chamber is an upper one. Accordingly, the arrangement of the tubes, double-walled members and the casing may not necessary be circular in cross-sectional view. Therefore, the term "annular" used in the specification and claims is to be regarded as not being limited to circular.

In the foregoing, the boiler of this invention has been described as a water tube type effecting circulation of the water through the upper water chamber, down comers (or double walled member), the lower water chamber and the riser tubes (or double-walled member). However, the boiler according to the present invention may be used as a once-through type wherein the water level is considered as existing in the intermediate portion of the tube walls or the double-walled member.

Further, although the embodiments have been described as being vertical type boilers, the construction of the boiler according to the present invention may be also applicable to a horizontal type boiler with similar effects and advantages wherein the boiler is preferably canted relative to the horizontal direction.

While the present invention has been described in detail with respect to the specific embodiments, it will be apparent to those skilled in the art that modification and changes are available within the spirit and scope of the present invention which will be defined in the claims annexed.

What is claimed is:

1. A boiler comprising:

a tubular casing;

a pair of annular chambers disposed at opposite ends of said tubular casing and joined thereto, respectively;

a first closed annular wall means within said casing extending coaxially with said casing and spaced from said casing to leave an outer flue therebetween and having an outer wall portion and an inner wall portion defining a space therebetween which is coupled with both said chambers at the opposite ends of said wall means so as to place said chambers in communication through said space;

second closed annular wall means within said casing and within said first wall means and spaced from said first wall means to define an inner flue between said first wall means and said second wall means, said second wall means having an outer wall portion and an inner wall portion defining a space therebetween which is coupled with both said chambers at the opposite ends of said wall means so as to place said chambers in communication through said space;

said second wall means and said pair of annular chambers defining within the centers thereof a combustion chamber, the center hole of one of the annular chambers being closed;

a burner extending through the center hole of the other annular chamber and directed toward said combustion chamber;

an exhaust opening located in the casing and communicating with said outer flue;

first gas duct means extending through said first wall means from said inner flue to said outer flue, said first duct means having intake opening means opening into said inner flue adjacent one of said annular chambers and a first discharge opening means opening into said outer flue adjacent the other of said annular chambers;

second gas duct means extending through said second wall means from said combustion chamber to said first flue, said second duct means having intake opening means opening into said combustion chamber adjacent said other of said annular chambers and a discharge opening means opening into said inner flue adjacent said one of said annular chambers; and additional gas passage means extending through said second wall means adjacent said other annular chamber.

2. A boiler as claimed in claim 1 wherein further additional gas passage means are provided extending through said second wall means adjacent said one of said annular chambers.

3. A boiler as claimed in claim 1 wherein said first and second wall means are comprised of a plurality of tangent water tubes contiguously arranged to form first and second tube walls, respectively, and said first and second duct means are a plurality of tubes which are positioned within at least some of said water tubes.

4. A boiler as claimed in claim 2 or 3 wherein said first and second wall means are comprised of a plurality of tangent water tubes contiguously arranged to form first and second tube walls, respectively, and said first and second duct means are a plurality of tubes which are positioned within at least some or said water tubes, at least one end of at least some of said tubes being reduced in diameter to form said additional gas passage means in the respective wall means.

5. A boiler as claimed in claim 3 wherein said water tubes are finned type water tubes and the fins of adjacent water tubes are joined with each other to form said first and second tube walls.

6. A boiler as claimed in claim 5 wherein the fins in said second wall means have openings therein constituting said additional gas passage means extending from said combustion chamber to said inner flue.

7. A boiler as claimed in claim 6 wherein the fins in said second wall means have openings therein adjacent said one of said annular chambers and constituting additional gas passage means extending from said inner flue to said outer flue.

8. A boiler as claimed in claim 1 wherein said tubular casing is vertically positioned and one of said annular chambers is disposed at the upper end of said annular wall means and the other of said chambers is disposed at the lower end of said annular wall means, the lower chamber being a water chamber and said boiler being a once-through type boiler.

9. A boiler as claimed in claim 8 wherein both said tubular casing and said annular wall means are cylindrical and each of said annular chambers is circular.

10. A boiler as claimed in claim 1 wherein said tubular casing is vertically positioned and one of said annular chambers is disposed at the upper end of said annular wall means and the other of said chambers is disposed at the lower end of said annular wall means, said upper and lower chambers being a circulation type boiler.

11. A boiler as claimed in claim 10 wherein both said tubular casing and said annular wall means are cylindrical and each of said annular chambers is circular.

12. A boiler as claimed in claim 3 wherein said intake and discharge opening means are a plurality of intake openings and discharge openings, said intake openings in the tube wall and said discharge openings in said second tube wall are at approximately the same level adjacent said one of said chambers and said discharge openings in said first tube wall and said intake openings in said second tube wall are approximately at the same level adjacent said other one of said chambers.

* * * * *